United States Patent [19]

Hayskar

[11] 4,401,301

[45] Aug. 30, 1983

[54] SHEET FEEDER CONTROLLED BY FED SHEET

[75] Inventor: Robert A. Hayskar, Palatine, Ill.

[73] Assignee: Xerox Corporation, Stamford, Conn.

[21] Appl. No.: 265,280

[22] Filed: May 20, 1981

[51] Int. Cl.[3] ..... B65H 3/12

[52] U.S. Cl. ..... 271/96; 137/625.22; 137/625.44; 137/625.66; 271/99; 271/106

[58] Field of Search ..... 271/96, 94, 35, 12, 271/5, 11, 99, 95, 104, 105, 106, 108, 276, 197, 112, 132; 414/121, 128, 130; 137/625.22, 625.44, 625.66

[56] References Cited

U.S. PATENT DOCUMENTS

| | | | |
|---|---|---|---|
| 2,243,876 | 6/1941 | Maddox . | |
| 2,243,899 | 6/1941 | Fulcher . | |
| 3,212,772 | 10/1965 | Ward | 271/35 X |
| 3,312,464 | 4/1967 | Rehm | 271/96 |
| 3,620,526 | 11/1971 | Iles et al. | 271/96 |
| 3,649,002 | 3/1972 | Burkhardt | 271/96 |
| 3,973,768 | 8/1976 | Shannon | 271/99 |
| 4,062,536 | 12/1977 | Michelson | 271/177 |
| 4,157,177 | 6/1979 | Strecker | 271/197 |
| 4,221,377 | 9/1980 | Bodewein et al. | 271/183 |

FOREIGN PATENT DOCUMENTS 1271124 6/1968 Fed. Rep. of Germany .

OTHER PUBLICATIONS

Boase, E. et al. "Recirculating Document Feeder", *Research Disclosure,* Feb. 1978, No. 166, pp. 38–39, Item 16,659.

Souba, C. H. "Vacuum Document Picker", *IBM Technical Disclosure Bulletin,* vol. 13, No. 9, Feb. 1971, p. 2567.

*Primary Examiner*—Bruce H. Stoner, Jr.

*Attorney, Agent, or Firm*—Frederick E. McMullen

[57] ABSTRACT

A sheet feeder employing a vacuum feed belt in conjunction with a vacuum control plenum immediately adjacent the downstream edge of the vacuum belt, a self actuating valve being provided to shut off the vacuum supply to the feed belt when the sheet being fed blocks the openings in the control plenum to prevent acquisition of a second sheet by the feed belt until the trailing edge of the sheet being fed clears the control plenum.

5 Claims, 6 Drawing Figures

SHEET FEEDER CONTROLLED BY FED SHEET

BACKGROUND OF THE INVENTION

In order to separate a sheet from a sheet stack and feed the sheet from the stack, a number of devices have been utilized. Friction feed rolls or belts, vacuum sniffer tubes, and vacuum feed rolls are among the most common of these devices. Vacuum feed devices have an advantage in handling light weight or easily damaged sheets or documents since there is minimal scuffing or scrubbing of the document or sheet by the feeder. While vacuum feed rolls work well, in instances where sheet separation may be difficult and/or a more positive feed is desired, vacuum feed belts may be employed. However, vacuum based feed belt systems often experience relatively high misfeed rates due to premature engagement of the feed belt with the next succeeding sheet before the feeding of the previous sheet has been completed. For, as can be understood, as the sheet is fed forward the trailing edge of the sheet gradually uncovers the vacuum ports or apertures in the vacuum feed belt plenum. This causes the next sheet in the stack to be prematurely acquired by the vacuum belt and may result in a sheet jam or multifeed condition.

To obviate this tendency, various corrective devices have been employed. For example, vacuum hold down devices located adjacent the rear edge of the sheet stack which are actuated after the trailing edge of the sheet being fed has cleared the vacuum hold down ports, friction retard pads to prevent multiple fed sheets from reaching the take-away rolls downstream from the feeder, gate type feeders wherein a control gate is carefully adjusted to approximately one sheet thickness such that only one sheet will fit through the gate, and the like. However, devices of the aforementioned types have drawbacks. For example, vacuum hold down devices require precise timing controls in order to actuate the hold down device at the precise moment that the trailing edge of the sheet being fed leaves the vacuum hold down ports. Friction retard devices, due to contact with the sheets being fed, may degrade any printed matter on the sheets. Further, the frictional characteristics of the retard surface may change due to wear, humidity, etc. And, throat or gate control feeders often require constant adjustment of the throat dimension to accommodate changes in the type and thickness of sheets being fed.

The present invention seeks to obviate the aforementioned problems by providing an automatic vacuum controlled vacuum based belt feeder wherein once the sheet being fed is acquired by the take-away rolls, the vacuum is automatically shut off from the vacuum feed belt plenum to prevent multifeeds.

SUMMARY OF THE INVENTION

A sheet feeder employing a vacuum belt assembly for separating sheets seriatim from a sheet stack. Vacuum control port means located downstream from the sheet stack cooperate with control valve means to interrupt communication between the vacuum supply source and the belt assembly in response to closing off of the control port means by the sheet being fed to prevent acquisition of the next sheet by the belt assembly until the trailing edge of the sheet being fed has moved past the control port means.

DESCRIPTION OF THE PREFERRED EMBODIMENT

Figure 2:
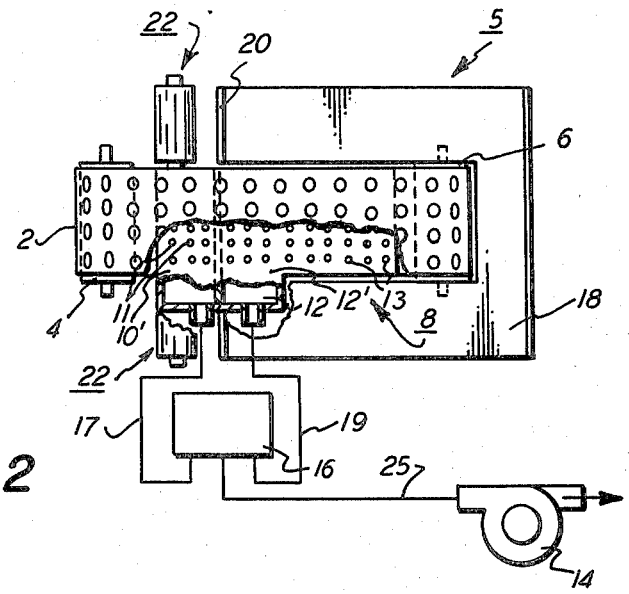
FIG. 2 is a top view partially in section of the feeder shown in FIG. 1.
Figure 1:
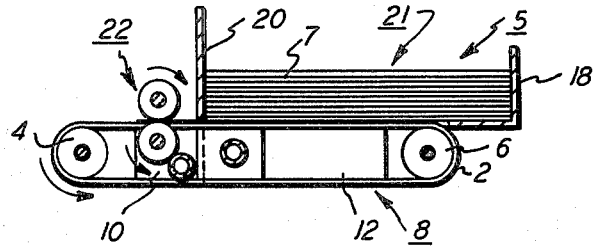
FIG. 1 is a side view, partially in section of the sheet feeder of the present invention.

Referring to FIGS. 1 and 2 there is illustrated the vacuum based sheet feeder 5 of the present invention. Sheet feeder 5 includes a perforated feed belt 2 supported for movement by rolls 4 and 6. Rolls 4, 6 are suitably journaled for rotation in the sheet feeder frame (not shown). One or both rolls 4, 6 may be driven by a suitable motor (not shown).

A two chambered vacuum plenum 8 having a control chamber 10 and a feed chamber 12, is disposed within the run of the belt 2. Plural openings 11, 13 are provided in the upper surfaces 10', 12' respectively of control and feed chambers 10, 12. As will appear, control chamber 10 and feed chamber 12 are selectively connected to a source of vacuum, illustrated herein by blower 14, through a vacuum control valve 16. Conduits 17, 19 couple valve 16 with control and feed chambers 10, 12 respectively while conduit 25 couples valve 16 with the vacuum source 14. A feed tray 18 having a discharge gate 20 is provided for supporting a stack 21 of sheets 7 to be fed by the sheet feeder 5 such that the bottom most sheet in the stack 21 rests on the upper surface of feed belt 2. Pinch roll pairs 22 which are suitably journaled in the sheet feeder frame (not shown) and driven in the direction shown by the solid line arrows by suitable means (not shown), are provided downstream of discharge gate 20 for advancing sheets 7 fed forward by belt 2 to subsequent sheet processing stations (not shown).

Sheets 7 may comprise any suitable sheet material such as envelopes, postcards, magazines, newspapers, and the like.

Figure 3:
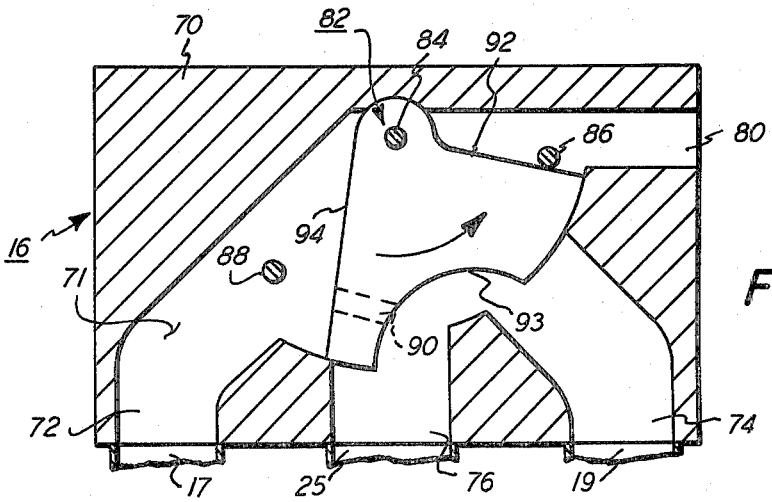
FIG. 3 is an enlarged sectional view of the sheet feeder control valve showing the control valve in the sheet feed position.
Figure 4:
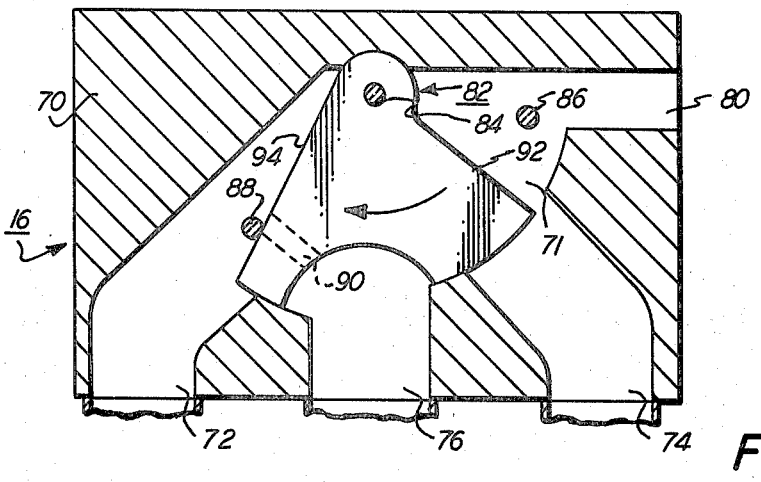
FIG. 4 is an enlarged sectional view of the sheet feeder control valve showing the control valve in the sheet feed interrupt position.

Referring particularly to FIGS. 3 and 4, control valve 16 includes a valve body 70 having an internal valve chamber 71. Control port 72 in valve chamber 71 is coupled to control chamber 10 by means of conduit 17 while feeder port 74 in valve chamber 71 is coupled to feed chamber 12 by means of conduit 19. Port 76 in valve chamber 71 is coupled to vacuum source 14 through conduit 25 while vent port 80 in valve chamber 71 communicates with the atmosphere.

A movable valve element 82 is pivotally mounted within valve chamber 71, valve element 82 being supported for swinging movement by journal pin 84. Valve stops 86, 88 limit swinging movement of valve element 82 in the counter clockwise and clockwise directions respectively. A bleed port 90 is provided in valve element 82 between control port 72 and port 76.

Referring to FIGS. 1–4, on start-up of the sheet feeder 5, vacuum source 14 is actuated to provide vacuum to port 76 of control valve 16. The admission of low pressure to port 76 causes valve element 82 to assume the position shown in FIG. 3 with surface 92 of valve element 82 abutting valve stop 86. This disposition of valve element 82 is due to the fact that the area of surface 92 of valve element 82, which is open to the atmosphere through port 80, is less than the area of the surface 94 of valve element 82 which is similarly open to the atmosphere through port 72 and openings 11 in control chamber 10. Since pressures are substantially the same on both surfaces 92, 94 and the interior surface 93 of valve element 82 is exposed to low pressure, the greater force developed on surface 94 causes the valve element 82 to swing in a counter clockwise direction to the position shown in FIG. 3.

In this position of valve element 82, port 76 communicates with feeder port 74 thereby providing, through conduit 19, vacuum to feed chamber 12 and the portion of the perforated feed belt 2 opposite thereto. As a result, the bottom most sheet in stack 21 in feed tray 18 is drawn into contact with the upper surface of belt 2.

On movement of feed belt 2, the bottom most sheet is carried forward under discharge gate 20 and into the nip formed by pinch roll pairs 22. As the sheet advances, the leading edge of the sheet blocks or closes the openings 11 in control chamber 10 to the atmosphere. This results in a pressure drop in control port 72 due to the cutoff of communication with the atmosphere and the bleeding of relatively high pressure air from port 72 to port 76 through bleed port 90. As a result, the surface 94 of valve element 82 is exposed to less relative pressure than the surface 92. This change in pressure differential causes the valve element 82 to swing in a counter clockwise direction until surface 94 engages valve stop 88 (the position shown in FIG. 4). In this instance, the pressure differential between the surfaces 92, 94 is great enough to offset the disparity in area between surfaces 92, 94.

With valve element 82 in the position shown in FIG. 4, feeder port 74 is closed to the vacuum source 14 and the vacuum in feed chamber 12 is dissipated to atmosphere through vent port 80. The rise in pressure in feed chamber 12 breaks the vacuum induced engagement between the sheet being fed and belt 2 while at the same time inhibiting premature grasping and feeding of the next sheet in stack 21 by belt 2 as the previous sheet is fed forward and openings 13 in feed chamber 12 are uncovered.

The sheet being fed is advanced forward by pinch roll pair 22 and as the sheet trailing edge clears the area above control chamber 10, uncovering openings 11 in control chamber 10, control port 72 is again opened to the atmosphere. With port 72 open to atmospheric pressure, valve element 82 reverts to the position shown in FIG. 3 to again communicate feed chamber 12 to low pressure and cause belt 2 to grasp and feed forward the next sheet in stack 21 as described heretofore.

Figure 5:
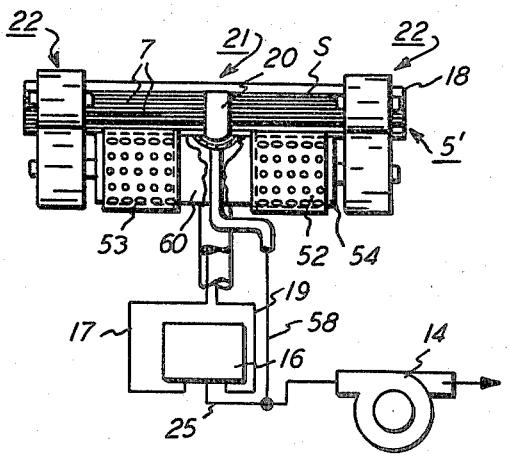
FIG. 5 is a side view, partially in section illustrating a second embodiment of the invention.
Figure 6:
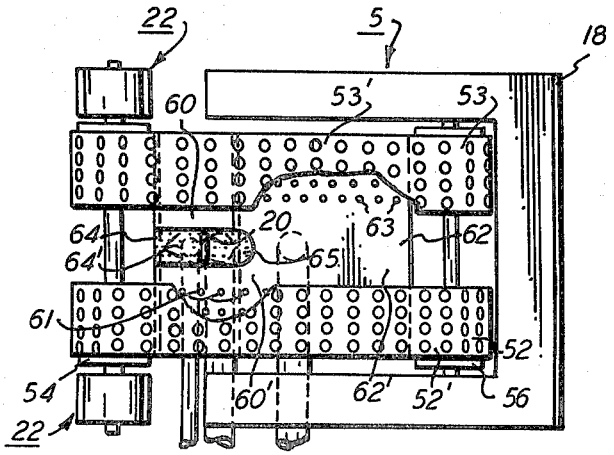
FIG. 6 is a top view, partially in section of the feeder of FIG. 5.

Referring now to the embodiment shown in FIGS. 5 and 6, where like numerals refer to like parts, the sheet feeder 5' there shown has spaced perforated feed belts 52, 53 supported by rolls 54, 56 are suitably journaled for rotation in the sheet feeder frame (not shown). One or both rolls may be driven by a suitable drive motor (not shown).

Control and feed chambers 60, 62 are disposed under belts 52, 53, the dimension of chambers 60, 62 being such that chambers 60, 62 extend from one edge 52' of belt 52 to the edge 53' of belt 53. Openings 61, 63 in the upper surfaces 60', 62' of chambers 60, 62 opposite belts 52, 53 communicate the interior of chambers 60, 62 with belts 52, 53.

A relatively small vacuum chamber 64 is provided between belts 52, 53 adjacent the sheet discharge end of belts 52, 53, chamber 64 being disposed atop control chamber 60. The center portion of control chamber 60 is suitably recessed for this purpose. The upper surface 64' of vacuum chamber 64 is preferably slightly concave with openings 65 therein communicating chamber 64 with the atmosphere. Discharge gate 20 is spacedly disposed above surface 64' of chamber 64. Chamber 64 is coupled directly to vacuum source 14 through conduit 58, bypassing control valve 16.

Admission of vacuum to the small chamber 60 causes the sheet to bow or arc, facilitating passage of the sheet leading edge under discharge gate 20 while reducing the tendency of the sheet to bend or buckle in the direction of sheet movement.

Operation of the FIGS. 5 and 6 embodiment is similar as that described heretofore in connection with FIGS. 1–4, the bottom most sheet 7 in tray 18 being advanced forward under discharge gate 20 and into the nip of pinch roll pairs 22. During this period, valve element 82 of control valve 16 is in the position shown in FIG. 3 thereby communicating feed chamber 62, and the portion of feed belts 52, 53 thereabove with vacuum source 14 via conduits 19, 25.

As the leading edge of the sheet being fed advances under discharge gate 20 and across the upper surface 60' of control chamber 60, openings 61 of chamber 60 are progressively closed off. As described, this results in a change in pressure differential across valve element 82 with the result that valve element 82 swings in a clockwise direction to the position shown in FIG. 4, closing off communication of feed chamber 62 with vacuum source 14 and opening chamber 62 to the atmosphere. As a result, the vacuum induced drive between feed belts 52, 53 and the sheet being fed is broken. At the same time, premature feeding of the next sheet in tray 18 by belts 52, 53 is prevented.

As the trailing edge of the sheet being fed passes across control chamber 60, openings 61 threin are uncovered to move valve element 82 counter clockwise to the position shown in FIG. 3 for feeding of the next sheet in tray 18.

A feed roll (not shown) may be provided opposite vacuum chamber 64 to facilitate transporting of sheets into the nip of pinch roll pairs 22. Alternately, feed roll pairs (not shwon) may be provided on either side of vacuum chamber 64 for this purpose.

While the invention has been described with reference to the structure disclosed, it is not intended to cover such modifications or changes as may come within the scope of the following claims:

What is claimed is:

1. A sheet feeder for separating and feeding sheets seriatim from a stack of sheets comprising:

a sheet tray for holding sheets to be fed;

a vacuum belt assembly disposed in operative relationship below said tray for contact with the bottom most sheet in said tray;

vacuum control port means located adjacent the discharge side of said tray; and control valve means interconnected with said vacuum control port means and said vacuum belt assembly for controlling the vacuum supply to the said belt assembly, said control valve means including a valve body having a valve chamber therein; and a valve element movably supported in said valve chamber for movement between a sheet feed position and a no feed position, said valve element having a first surface communicating with the atmosphere; a second surface communicating with said vacuum control port means, the area of said valve element first surface being less than the area of said valve element second surface; and a bleed passage communicating said vacuum control port means directly with said vacuum supply, movement of the sheet being fed across said vacuum control port means closing off said vacuum control port means to permit pressure on said valve element second surface to be reduced through said bleed passage to cause said valve element to move to said no-feed position wherein said valve element interrupts communication between said vacuum belt assembly and said vacuum supply to release the sheet being fed and prevent premature acquisition of the next sheet by said vacuum belt assembly until the trailing edge of the sheet being fed has moved clear of said vacuum control port means, movement of the sheet being fed past said vacuum control port means uncovering said vacuum control port means to increase pressure on said valve element second surface to cause said valve element to move to said sheet feed position wherein said valve element communicates said vacuum belt assembly with said vacuum supply.

2. The sheet feeder according to claim 1 wherein said vacuum belt assembly and said vacuum control port means include a vacuum plenum having separate control and feed chambers, said control chamber being located adjacent the discharge side of said tray;

said vacuum belt assembly including feed belt support rollers disposed at opposite ends of said vacuum plenum; and at least one belt supported by said rollers for feeding sheets from said stack.

3. The sheet feeder according to claim 1 including vacuum assist means for stiffening the sheet being fed.

4. The sheet feeder according to claim 3 in which said vacuum assist means comprises, (a) a chamber adjacent the discharge side of said sheet tray, said chamber forming a recessed surface over which the sheet being fed passes; and (b) means coupling said chamber to said vacuum supply to evacuate said chamber and draw the sheet being fed into conformance with said chamber surface whereby to cause the sheet being fed to bow thereby stiffening said sheet.

5. The sheet feeder according to claim 4 including a discharge gate for limiting the discharge of sheets from said sheet tray spaced above said chamber surface, drawing of the sheet being fed into conformance with said chamber surface facilitating passage of said sheet under said gate.

* * * * *